US010427700B2

(12) United States Patent
Nagrodsky et al.

(10) Patent No.: US 10,427,700 B2
(45) Date of Patent: Oct. 1, 2019

(54) RAILROAD TRACK CIRCUIT FOR DETERMINING THE OCCUPANCY STATUS OF A PORTION OF A RAILROAD

(71) Applicant: ALSTOM TRANSPORT TECHNOLOGIES, Saint-Ouen (FR)

(72) Inventors: Nicholas Nagrodsky, Melbourne, FL (US); Jeffrey Fries, Grain Valley, MO (US)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 228 days.

(21) Appl. No.: 15/452,114

(22) Filed: Mar. 7, 2017

(65) Prior Publication Data

US 2018/0257685 A1 Sep. 13, 2018

(51) Int. Cl.

| | |
|---|---|
| ***B61L 25/02*** | (2006.01) |
| ***E01B 26/00*** | (2006.01) |
| ***B61L 1/18*** | (2006.01) |

(52) U.S. Cl.

CPC ..... *B61L 25/025* (2013.01); *B61L 1/187* (2013.01); *E01B 26/00* (2013.01)

(58) Field of Classification Search

CPC ..... B61L 25/00; B61L 25/02; B61L 25/021; B61L 25/025; B61L 25/04

See application file for complete search history.

(56) References Cited

U.S. PATENT DOCUMENTS 3,479,502 A * 11/1969 Whitten ..... B61L 1/187 246/34 R

* cited by examiner

*Primary Examiner* — Robert J McCarry, Jr.
(74) *Attorney, Agent, or Firm* — Young & Thompson

(57) ABSTRACT

A railroad track circuit determines occupancy status of a portion of a railroad track, and includes: a track including first and second rails; a transmitter including first and second connection terminals to generate a voltage between connection terminals; and first and second receiver units, each including first and second measurement terminals, the first and second receiver units measuring voltage between first and second measurement terminals. The output connection terminals of the transmitter connect to the respective rails at a first connection location, using first and second cables. The first measurement terminal of the first receiver unit is connected to the first rail at a second connection location, using a third cable and the first measurement terminal of the second receiver unit is connected to the first rail at a third location, using a fourth cable, the second and third locations forming respectively first and second boundaries of the track circuit.

4 Claims, 1 Drawing Sheet

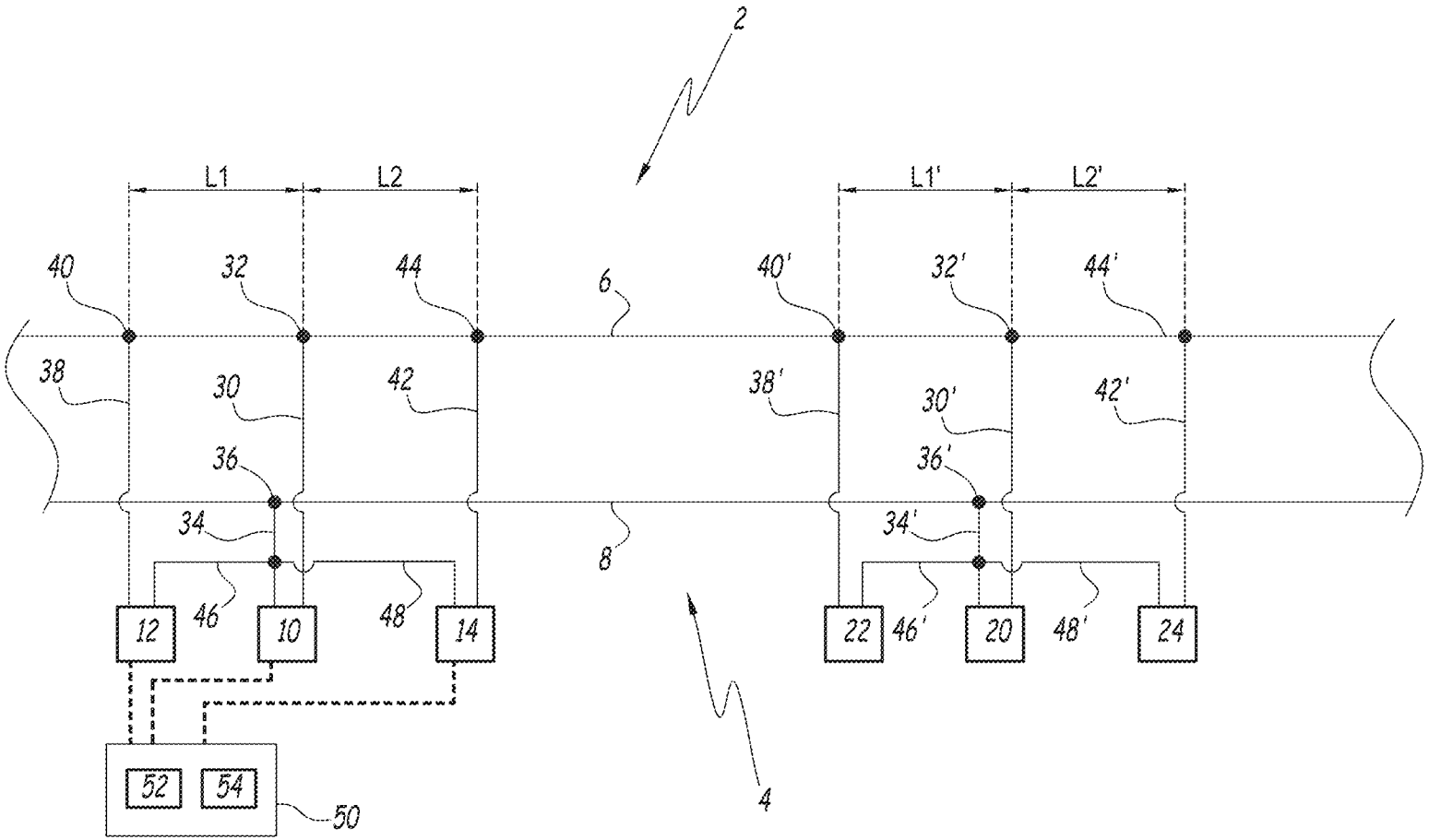
2
4
6
8
L1
L2
L1'
L2'
10
12
14
20
22
24
30
32
34
36
38
40
42
44
46
48
30'
32'
34'
36'
38'
40'
42'
44'
46'
48'
50
52
54

RAILROAD TRACK CIRCUIT FOR DETERMINING THE OCCUPANCY STATUS OF A PORTION OF A RAILROAD

FIELD OF THE INVENTION

The present invention relates to a railroad track circuit for determining the occupancy status of a portion of a railroad. More generally, the invention relates to the field of railroad infrastructure and signaling.

BACKGROUND OF THE INVENTION

The use of railroad track circuits is well known for determining the occupancy status of a portion of a railroad by a rail vehicle, such as a train, in order to guarantee safe operation of a railroad system.

Typically, railroad tracks are divided along their length into a plurality of track portions, also called track blocks, each associated with a track circuit. Each track circuit comprises a transmitter unit, which applies a voltage signal between the rails of the railroad track, and a measurement unit, which measures the voltage signal between the rails at a different location. When a train enters the track block, both rails forming the track are electrically connected through the axles of the train, which electrically shunts the track circuit. As a result, the measurement unit detects a variation of the voltage signal, thus indicating the occupancy status of the corresponding track block. Some examples of track circuits are known as DC track circuits or as audio frequency track circuits.

However, the boundary between neighboring track blocks must be clearly defined, in order to avoid any false determination of track block occupancy, which may have adverse consequences. In jointed railroad tracks, this is usually done by using electrically insulated joints between the track sections. In the case of jointless railroad tracks, where no such insulating joints are used, boundaries are usually defined by using impedance bonds that are placed on the track at specific locations. However, the installation of impedance bonds is costly and complicates the maintenance of the track.

Some known audio frequency track circuits purport to solve this problem, by using several receiver units in each track circuit, said receiver units being placed on each side of the transmitter unit, in order to define virtual boundaries. An example of such track circuits is disclosed in U.S. Pat. No. 3,479,502.

However, such known solutions are not entirely satisfactory. One reason is that, due to the extra receiver units, the cabling required to connect the various elements to the tracks is much more complicated. This increased complexity may be detrimental to the installation of the track circuit and complicates its maintenance.

SUMMARY OF THE INVENTION

The object of the present invention is therefore to provide a railroad track circuit for jointless railroad tracks that does not require the use of impedance bonds and that is able to be built and operated in a simplified way.

To that end, the invention relates to a railroad track circuit adapted to determine the occupancy status of a portion of a railroad track, said track circuit including:

a railroad track comprising first and second rails;

a transmitter unit comprising first and second connection terminals and being adapted to generate a voltage signal between the first and second connection terminals;

a first and a second receiver units, each comprising a first measurement terminal and a second measurement terminal, the first and a second receiver units being each adapted to measure a voltage signal between their respective first and second measurement terminals;

and wherein:

the first and second output connection terminals of the transmitter unit are connected to the first and second rails at a first connection location, respectively using a first cable and a second cable;

the first measurement terminal of the first receiver unit is connected to the first rail at a second connection location, using a third cable and the first measurement terminal of the second receiver unit is connected to the first rail at a third location, using a fourth cable, the second and third locations forming respectively first and second boundaries of the track circuit;

the second measurement terminal of the first and second receiver units are both connected to the second terminal of the transmitter unit by means of wayside cables.

An advantage of the invention is that, by connecting the respective second measurement terminals of the measurement units to the second connection terminal of the transmitter unit itself, instead of connecting them directly to the track, the voltage signal between the tracks can still be adequately measured without having to use a pair of cables dedicated to each measurement unit. As a result, only four cables are needed to connect the tracks to the track circuit equipment located on the wayside, instead of using six cables as is known from existing tracks circuits. This simplifies the installation of the track circuit. This is especially interesting when the track circuit is to be installed on an existing railroad track which was already equipped with legacy track circuit technology, as the old wiring can then be reused.

According to advantageous aspects, the invention may comprise one or more of the following features, considered alone or according to all possible technical combinations:

The transmitter unit is adapted to generate high frequency voltage signals, with a frequency greater than or equal to 10 kHz.

The first and the second locations are equidistant from the transmitter unit.

The railroad track circuit comprises an electronic calculator unit programmed to compare the voltage signals measured by the first and second measurement units with at least one predefined threshold value, the occupancy status being determined as a result of this comparison.

BRIEF DESCRIPTION OF THE DRAWINGS

The invention will be better understood upon reading the following description, provided solely as an example and made in reference to the appended drawing, in which:

FIG. 1 is a simplified top-view illustration of a portion of a railroad track comprising a track circuit according to an embodiment of the invention.

DETAILED DESCRIPTION OF SOME EMBODIMENTS OF THE INVENTION

FIG. 1 is a simplified diagram illustrating a track circuit system 2 for use with a railroad track 4. In this diagram, only a portion of the length of railroad track 4 is illustrated.

Railroad track 4 comprises a first rail 6 and a second rail 8, parallel and spaced apart from each other, and laid over a support structure such as a ballast layer, not illustrated. The structure of railroad 4 is well known and is not described in further detail in what follows. In this example, railroad track 4 is a jointless railroad track.

System 2 comprises a first track circuit including a transmitter unit 10, a first receiver unit 12 and a second receiver unit 14.

Transmitter unit 10 is adapted to generate a voltage signal, such as an AC voltage signal, and to transmit this voltage signal to both rails 6 and 8 of railroad track 4. For example, transmitter unit 10 comprises a signal generator, not illustrated. Transmitter unit 10 also comprises first and second output connection terminals meant to be electrically connected to rails 6 and 8 in order to transmit said voltage signal.

In this embodiment, the first track circuit comprises a first electrical cable 30, or wire, and a second electrical cable 34. Cable 30 electrically connects the first connection terminal of unit 10 to the first rail 6 at point 32. Cable 32 electrically connects the second connection terminal of unit 10 to the second rail 8 at point 36. Cables 30 and 32 may include impedance matching couplers.

Therefore, the voltage signal generated by unit 10 between the output connection terminals is applied between rails 6 and 8 a first connection location on railroad track 4, this location being defined here by points 32 and 36.

In the example of FIG. 1, for illustrative purposes, points 32 and 36 are shown slightly offset laterally from each other. By "offset laterally", it is meant here that points 32 and 36 are offset from each other along the length of track 4.

In practice, points 32 and 36 may be laterally offset from each other by a small distance, i.e. a distance smaller than one meter, and in any case significantly smaller, e.g. ten times smaller, than the distance between this first connection location and the nearest measurement unit 12 or 14. However, points 32 and 36 are preferably facing each other with no lateral offset, i.e. aligned together along a direction perpendicular to rails 6 and 8.

In a preferred embodiment, unit 10 is able to generate an AC high-frequency signal voltage. For example, this high frequency is higher than or equal to 10 kHz, or higher than or equal to 100 kHz or, preferably, higher than or equal to 1 MHz.

The use of a high-frequency voltage signal allows the definition of virtual boundaries of the track circuit. As a consequence, it is not necessary to use impedance bonds to define boundaries at the ends of the track circuit. This is due to the fact that high frequency voltage signals cannot propagate over long distances along railroad track 4, due to signal attenuation caused by the inductance of the rails 6, 8 and also to signal losses resulting from interactions with the ballast.

In this illustrative example, the voltage signal generated by unit 10 is a sine wave having a frequency equal to 10 kHz and an amplitude equal to 40 V RMS at the output of unit 10. The voltage signal actually delivered between rails 6 and 8 at points 32 and 36 has an amplitude equal to 550 mV RMS. The difference between the output voltage and the delivered voltage signal is usually due to cables 30, 32 and the impedance matching coupler used for connecting the output connection terminals to rails 6 and 8.

Measurement units 12 and 14 are each adapted to measure a signal voltage between rails 6 and 8. For example, each unit 12, 14 includes a voltage sensor. In this exemplary embodiment, units 12 and 14 are similar or preferably identical to each other.

Measurement units 12 and 14 each comprise a first measurement connection terminal and a second measurement connection terminal, meant to be electrically connected to railroad track 4 in order to measure a voltage signal between rails 6 and 8.

In this embodiment, the first track circuit further comprises a third electrical cable 38 and a fourth electrical cable 42. Cable 38 electrically connects the first measurement terminal of unit 12 to the first rail 6 at point 40. Cable 44 electrically connects the first measurement terminal of unit 14 to the first rail 6 at point 44. Cables 38 and 44 are preferably similar or even identical to cables 30 and 32.

Additionally, the first track circuit comprises two wayside cables 46 and 48, which extend along railroad track 4 and which are not directly connected to rails 6 and 8. For example, cables 46 and 48 are laid on the ballast along track 4.

Cable 46 electrically connects the second measurement terminal of unit 12 to the second connection terminal of unit 10. Cable 48 electrically connects the second measurement terminal of unit 14 to the second connection terminal of unit 10.

A noteworthy advantage is that, by connecting the respective second measurement terminals of units 12 and 14 to the second connection terminal of transmitter unit 10 itself, instead of connecting them directly to track 4, the voltage signal between tracks 4 can still be adequately measured without having to use a pair of cables dedicated to each measurement unit.

As a result, only four cables are needed to connect tracks 4 to the first track circuit equipment located on the wayside, instead of using six cables as is known from existing track circuits. This simplifies the installation of the track circuit. This is especially useful when the track circuit is to be installed on an existing railroad track which was already previously equipped with legacy track circuit technology, as the old wiring can then be reused. The installation and upkeep of the track circuit are therefore simplified.

Points 40 and 44 define, respectively, a second connection location and a third connection location along track 4. The distance between point 40 and the first connection location is noted L1 and distance between point 44 and the first connection location is noted L2.

Preferably, distances L1 and L2 are identical, meaning that points 40 and 44 are spaced apart and equidistant from the first connection location. In other words, transmitter unit 10 is placed between receiver units 12 and 14 and is equidistant from both receiver units 12, 14.

In practice, receiver units 12, 14 are located close to points 40 and 44, respectively. As a consequence, in this specification, the location of measurement units 12, 14 relative to transmitter unit 10 is roughly the same to the location of points 40 and 44 relative to the first connection location, respectively.

Due to this connection arrangement, and more specifically due to the spatial arrangement of points 40 and 44 on track 4, measurement units 12 and 14 define first and second boundaries of the first track circuit.

In this exemplary embodiment, distances L1 and L2 are between 1 meter and 10 meters.

Distances L1 and L2 are not drawn to scale on FIG. 1 in order to improve readability.

The first track circuit is associated with an electronic calculator unit 50. Unit 50 comprises a computer including an electronic processor 52 and a memory 54. For example, processor 52 is a CPU able to run executable instructions stored in memory 54. In an exemplary embodiment, memory 54 is as a Flash module, or an EEPROM module or a hard-disk drive or the like. Unit 50 also comprises an internal communication bus linking processor 52 with memory 54 and a power source, both not illustrated.

Unit 50 is connected to transmitter unit 10 and to measurement units 12 and 14 by means of a data exchange device, such as a wired serial connection, or a wired data fieldbus, or a wireless communication link. Unit 50 is possibly located near track 4. Advantageously, unit 50 is also in communication with a remote control center and/or an interlocking facility overseeing the operation of track 4, in order to provide real-time information on the occupancy status of the corresponding portion of track 4.

Unit 50 is programmed to automatically determine the occupancy status of the portion of track 4 associated to the first track circuit, thanks to executable instructions stored in memory 54. This determination is performed by collecting data representative of the voltage signal values measured by units 12 and 14 and by comparing the amplitude values of these signals to at least one predefined threshold value, as explained in what follows. The threshold value may depend on the value of the voltage signal generated by transmitter unit 10. In other words, unit 50 is programmed to compare the voltage signals measured by measurement units 12 and 14 with at least one predefined threshold value, the occupancy status being determined as a result of this comparison.

Separate threshold values may be defined for each of measurement units 12 and 14. In that case, the measured voltage signal amplitude is compared to the threshold value associated to the corresponding measurement unit.

If the amplitude of the voltage signal measured by at least one of units 12 and 14 is lower than the threshold value, then the corresponding portion of track 4 is said to be occupied by a rail vehicle. Otherwise, the portion of track 4 is said to be free of any rail vehicle.

Optionally, other features of the measured voltages signal may be collected and compared with predefined threshold values, such as the frequency of the voltage signals.

Operation of the first track circuit is now described according to a possible embodiment, in reference to FIG. 1.

Initially, no rail vehicle is present inside track portion 4. Unit 50 automatically commands the emission of voltage signal by transmitter unit 10 and collects data relative to voltage signal values measured by units 12 and 14. The RMS amplitude of the voltage signal measured by units 12 and 14 is equal to a so-called nominal value. In this example, the measured amplitude is equal to 6 V RMS.

Then, a rail vehicle running on track 4 arrives towards the first track circuit. In this example chosen for illustrative purposes, the rail vehicle runs from the side where measurement unit 12 is located and towards the opposite side of the first track circuit, which corresponds to a movement from left to right on FIG. 1.

For example, the rail vehicle is a train, such as a freight convoy or a single locomotive. The train comprises a front axle, also named leading axle, and a rear axle. The front axle is the axle placed at the head of the train, while the rear axle is the last axle of the train. Axles of the train are made of an electrically conductive material, so as to electrically shunt the rails of track 4.

As the leading axle approaches point 40, i.e. approaches the first boundary of the first track circuit, then the amplitude of the signal measured by unit 12 begins to decrease, while the amplitude of the signal measured by unit 14 remains the same.

Once the leading axle has crossed point 40 and is located between points 40 and 32, i.e. when it is between receiver unit 12 and transmitter unit 10, then the amplitude of the voltage signal measured by unit 12 drops below the predefined threshold value, e.g. below 1V RMS. The amplitude measured by unit 14 decreases as well, but not as much as that measured by unit 11 and remains above the threshold value.

The decrease below the threshold value indicates that the train is inside the portion of track 4. Unit 50 updates correspondingly the occupancy status of this portion of track 4. In a possible embodiment, memory 54 comprises an occupancy status indicator representative of the actual occupancy status of the corresponding portion of track 4. This indicator is modifiable by unit 50 and its status value is meant to be transmitted to the remote control center.

In this example, when the leading axle is placed at about 12 meters (40 feet) from point 32, the amplitude measured by unit 12 is equal to 33% of the nominal value. At the same time, the amplitude measured by unit 14 is equal to 50% of the nominal value while still being above the threshold value.

As the train continues to move, it eventually reaches transmitter unit 10. When the leading axle arrives at points 32 and 36, e.g. is at or between points 32 and 36, the track circuit is shunted and the transmitted voltage signal cannot propagate to either unit 12 or unit 14. Therefore, the amplitude value of the voltage signals measured by both units 12 and 14 drops below the threshold value.

When the leading axle moves past transmitter unit 10, i.e. moves past point 32 and/or 36, whichever is located further away along track 4, then the amplitude measured by unit 14 decreases as well below the threshold value. At the same time, the portion of track circuit between measurement unit 12 and transmitter unit 10 remains shunted until the rear axle passes and moves away from transmitter unit 10. From this point, the amplitude measured by unit 12 rises again, until it reaches the threshold value, indicating that the train has left this portion of the track circuit.

Finally, when the rear axle of the train has left the portion of track and moves away from point 46, i.e. moves away from the second boundary of the first track circuit, then the amplitude measured by unit 14 begins to increase again towards the first value. When this amplitude becomes again greater than the threshold value, then unit 50 detects that the train has left the portion of track. The occupancy status is updated in consequence. The first value is eventually reached when the rear axle is sufficiently far from unit 14 and from point 46, i.e. further than 500 meters or further than one kilometer.

In this exemplary embodiment, system 2 also comprises a second track circuit, similar or identical to the first track circuit.

The elements of this second track circuit are similar to that of the first track circuit and bear the same references with the appended symbol'. Due to these similarities, these elements are not described in detail in what follows, given that the description above can be transposed to these elements.

For example, the second track circuit comprises a transmitter unit 10', and receiver units 12' and 14', respectively similar to units 10, 12 and 14 and respectively connected to track 4 at points 32', 36', 40' and 44'. This second track circuit is associated to an electronic calculator unit similar to unit 50, and not illustrated here. In other embodiments, the second track circuit is controlled by the same unit 50 as the first track circuit.

The operation of the second track circuit is similar to that described above, except that the voltage signal amplitude values, their frequency and/or the distances L1' and L2', which correspond to distances L1 and L2, may take different values.

The second track circuit is placed on track 4 so that it does not overlap with the first track circuit. For example, the distance between points 32 and 32' is superior or equal to the sum of distances L1' and L2, e.g. greater than two miles.

Railroad track 4 may comprise one or more similar track circuits over its length.

In this example, due to the use of high frequency voltage signals and due to the distance between them, the first and second track circuits are insulated from each other, without it being necessary to use impedance bonds to insulate the track circuits from each other. The operation second track circuit is unaffected by the movements of the train at the first track circuit.

The embodiments and alternatives described above may be combined with each other in order to generate new embodiments of the invention.

The invention claimed is:

1. A railroad track circuit configured to determine an occupancy status of a portion of a railroad track, said track circuit comprising:

a railroad track comprising first and second rails;

a transmitter unit comprising first and second connection terminals and being configured to generate a voltage signal between the first and second connection terminals; and a first receiver unit and a second receiver unit, each of the first and second receiver units comprising a first measurement terminal and a second measurement terminal, the first and second receiver units each being configured to measure a voltage signal between the respective first and second measurement terminals, wherein the first and second output connection terminals of the transmitter unit are connected to the first and second rails at a first connection location, respectively using a first cable and a second cable, the first measurement terminal of the first receiver unit is connected to the first rail at a second connection location, using a third cable, and the first measurement terminal of the second receiver unit is connected to the first rail at a third location, using a fourth cable, the second and third locations forming respectively first and second boundaries of the track circuit, and the second measurement terminals of the first and second receiver units are both connected to the second terminal of the transmitter unit by wayside cables.

2. The railroad track circuit of claim 1, wherein the transmitter unit is configured to generate high frequency voltage signals, with a frequency greater than or equal to 10 kHz.

3. The railroad track circuit of claim 1, wherein the first and the second locations are equidistant from the transmitter unit.

4. The railroad track circuit of claim 1, further comprising an electronic calculator unit programmed to compare the voltage signals measured by the first and second measurement units with at least one predefined threshold value, the occupancy status being determined as a result of the comparison.

* * * * *